US007261244B2

(12) United States Patent
Urmson, Jr. et al.

(10) Patent No.: US 7,261,244 B2
(45) Date of Patent: Aug. 28, 2007

(54) TIE PLATE

(75) Inventors: William T. Urmson, Jr., Valencia, PA (US); John W. Mospan, Pittsburgh, PA (US); John M. Downey, Ashland, KY (US)

(73) Assignee: Portec Rail Products, Inc., Pittsburgh, PA (US)

( * ) Notice: Subject to any disclaimer, the term of this patent is extended or adjusted under 35 U.S.C. 154(b) by 0 days.

(21) Appl. No.: 11/269,160

(22) Filed: Nov. 7, 2005

(65) Prior Publication Data

US 2006/0118649 A1 Jun. 8, 2006

Related U.S. Application Data

(63) Continuation of application No. 10/688,206, filed on Oct. 17, 2003, now abandoned.

(60) Provisional application No. 60/419,609, filed on Oct. 18, 2002.

(51) Int. Cl.
*E01B 3/00* (2006.01)

(52) U.S. Cl. ..... 238/287; 238/152; 238/154; 238/283; 238/382; 238/264; 238/310; 238/336; 238/338; 238/351; 238/292

(58) Field of Classification Search ..... 238/264, 238/283, 266, 280, 287, 305, 306, 382, 151, 238/152, 154, 184, 187, 243, 269, 310, 336, 238/338, 351, 292
See application file for complete search history.

(56) References Cited

U.S. PATENT DOCUMENTS 979,478 A * 12/1910 Hall ..... 238/243
1,792,620 A * 2/1931 Wells ..... 238/283
2,867,384 A * 1/1959 Toulmin, Jr. ..... 238/283
2,996,256 A * 8/1961 Moses ..... 238/283
3,080,120 A * 3/1963 De Turk ..... 238/152
3,358,927 A * 12/1967 Hein et al. ..... 238/338
3,566,048 A 2/1971 Martin
4,047,663 A * 9/1977 Reynolds et al. ..... 238/304
4,635,846 A 1/1987 Todd
5,203,501 A * 4/1993 Vanotti ..... 238/265
5,782,406 A 7/1998 Igwemezie
6,131,272 A 10/2000 Girouard, Sr. et al.
6,170,756 B1 1/2001 Adkins et al.
6,179,215 B1 1/2001 Shea
6,305,613 B1 10/2001 Igwemezie
6,305,614 B1 10/2001 Adkins et al.
6,308,897 B1 10/2001 Remington et al.
6,422,479 B1 7/2002 Adkins et al.

OTHER PUBLICATIONS

Web site pp. 1 and 2 for an epoxy fiberglass insulated rail joint manufactured by Portec Rail Products, Inc., available at www.Portecrail.com, © 2001.
Web site pp. 1 and 2 for a Poly-Insulated® gauge plate insulator manufactured by Portec Rail Products, Inc., available at www.Portecrail.com, © 2001.

* cited by examiner

*Primary Examiner*—Mark T. Le
(74) *Attorney, Agent, or Firm*—The Webb Law Firm

(57) ABSTRACT

An electrically-insulated tie plate for electrically isolating parts of a railroad rail system from each other. The electrically-insulated tie plate includes a base plate having a recessed area for receiving a railroad rail and a layer of electrically-insulating material covering portions of the base plate.

24 Claims, 5 Drawing Sheets

TIE PLATE

CROSS REFERENCE TO RELATED APPLICATION

The present invention is a continuation of U.S. patent application Ser. No. 10/688,206 filed Oct. 17, 2003, now abandoned which claims the benefit of U.S. Provisional Patent Application Ser. No. 60/419,609, filed Oct. 18, 2002, which is hereby incorporated by reference in its entirety.

BACKGROUND OF THE INVENTION

1. Field of the Invention

The present invention relates to an insulated tie plate for bracing and securing a railroad rail and, more particularly, to a tie plate for electrically isolating parts of a rail system from each other.

2. Description of Related Art

A rail system is generally divided into sections or blocks for detecting trains which permit more trains to travel on one stretch of track or railroad rails. Each section is electrically isolated from all other sections so that when no train is present, a high electrical resistance can be measured over the parallel railroad rails in that section. When a train enters the section, the train short circuits adjacent railroad rails and the electrical resistance drops, thus indicating that a train is in that section.

A tie plate, typically made of metal, is used to secure a railroad rail against lateral, rotational, and vertical movements. See, for example, U.S. Pat. No. 6,179,215. Railroad rails are generally joined to each other by welding each end or by attaching the ends using a steel rail joint. Generally, high performance, non-metallic rail joints are used for electrically isolating two railroad rails in order to build an electrically isolated section. However, when two separate railroad rail sections are joined using a typical metal tie plate, electrical isolation of the railroad rail sections will not occur because the current will pass from one railroad rail section through the tie plate and then to the adjacent railroad rail section. Non-metallic insulating tie plates are typically very expensive because of the special high-performance materials needed to endure the high tensile and flexural forces acting on the railroad rail. Also, prior art initially utilized unsupported joints, but due to insulated joints and to high rail traffic, the industry has switch to supported joints. However, the supported joints typically have been made of polyurethane, which cannot take the high rail traffic and fail prematurely.

It is, therefore, an object of the present invention to provide an insulating tie plate whereby the above drawbacks are eliminated.

SUMMARY OF THE INVENTION

The present invention provides for an insulating tie plate that includes a base plate having a first surface and defining a peripheral edge. A pair of longitudinally-extending shoulder members are defined on the base plate and can extend a width of the base plate. The pair of longitudinally-extending shoulder members define a recessed area on the first surface of the base plate for accommodating a railroad rail therebetween. A plurality of slots are also defined on the base plate, wherein the slots are adapted to receive fasteners for securing both a railroad rail to the base plate and the base plate to a rail tie. A layer of electrically-insulating material may cover at least a portion of the base plate or encapsulates the base plate. The slots each define an inner surface, wherein the inner surface can be covered by an inner layer made of an electrically-insulating material. The base plate can be a metallic core and the electrically-insulating material can include a polymeric material or a polymeric material containing reinforcing fibers.

The present invention can also be a tie plate assembly for a railroad rail that includes an electrically-insulated tie plate adapted to receive a railroad rail, a plurality of slots defined on the tie plate, and a fastener passing through one of the slots for securing the tie plate to a rail tie. The electrically-insulated tie plate can be made of an electrically-insulated material or made according to the tie plate as previously described. The tie plate assembly can also include an electrically-insulated clip secured to the tie plate via the fastener, wherein the clip has a surface for coacting with the railroad rail and/or with a rail joint for securing the railroad rail to the tie plate. The surface of the clip can include a first ledge and a second ledge. The first ledge can adapt to coact with the railroad rail for securing the railroad rail to the tie plate. The second ledge can adapt to coact with a rail joint attached to the railroad rail for securing the railroad rail to the tie plate.

The present invention also provides for an electrically-isolated railroad rail system that includes a pair of railroad rails, a rail joint attaching each of the railroad rails together, an insulated tie plate having a plurality of slots for receiving the attached railroad rails, a fastener passing through one of the slots for securing the tie plate to a rail tie , and an electrically-insulated clip as previously described secured to the tie plate via the fastener, wherein the clip has a surface for coacting with the railroad rail and the rail joint.

DESCRIPTION OF THE PREFERRED EMBODIMENTS

Figure 1:
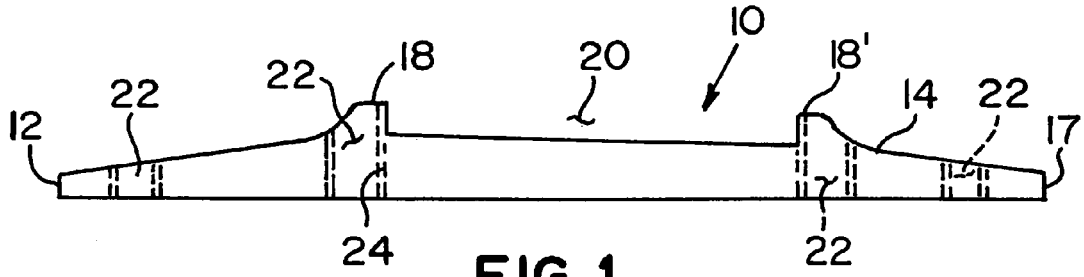
FIG. 1 is a side elevational view of a tie plate made in accordance with a first embodiment of the present invention.

The present invention prevents current from passing from one electrically-insulated railroad rail section through a tie plate to another railroad rail section by providing an electrically-insulated tie plate 10 whereby electric current cannot pass through.

FIGS. 1-4 show the tie plate 10 made in accordance with the present invention that includes a base plate 12 having an upper or first surface 14 and a bottom or second surface 16 and defining a peripheral edge 17. A pair of longitudinally-extending shoulder members 18, 18' are defined on the first surface 14 of the base plate 12 and can extend a width W of the base plate 12 (shown in FIGS. 2 and 4). The second surface 16 of the base plate 12 is generally flat. A recessed area 20 is defined between each shoulder member 18, 18' on the first surface 14 of the base plate 12 and is used to accommodate a railroad rail 56 therebetween (shown in FIG. 8). Also, a plurality of slots 22 having an inner surface 24 are defined on the base plate 12. A portion of the slots 22 extends transversely through the longitudinally-extending shoulder members 18, 18' from the upper surface 14 to the bottom surface 16 of the base plate 12. The slots 22 are generally adapted to receive fasteners 60 for securing the base plate 12 to a rail tie 86 (shown in FIG. 9). The base plate 12 can be a metallic core made from material such as steel.

Figure 2:
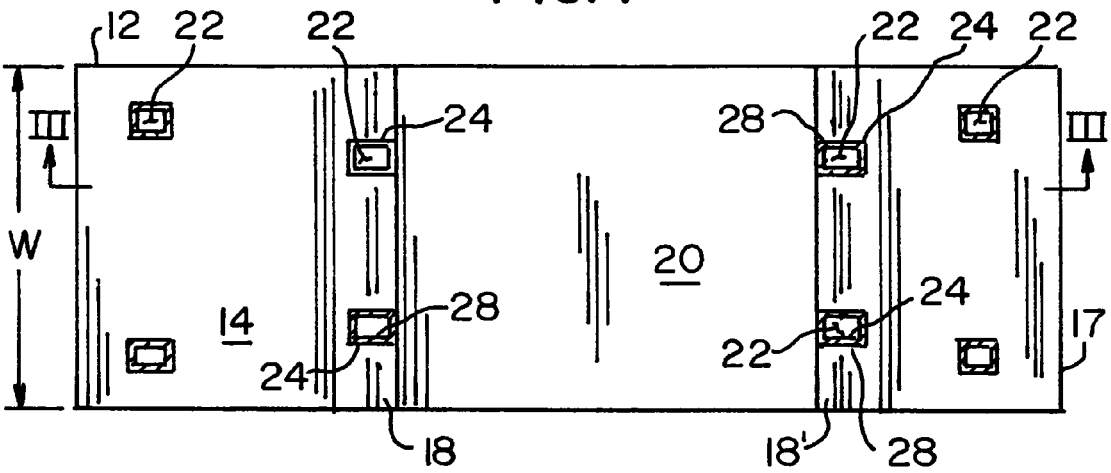
FIG. 2 is a top plan view of the tie plate shown in FIG. 1.
Figure 3:
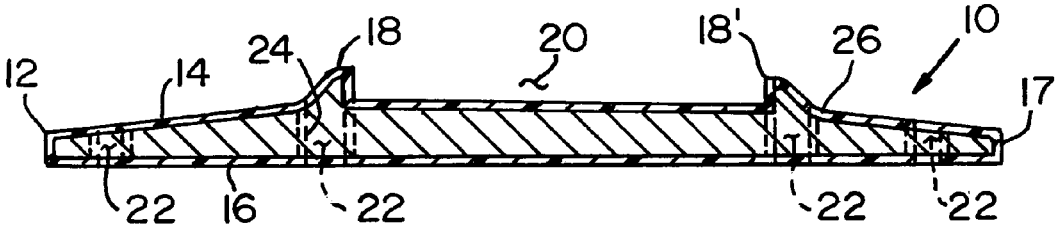
FIG. 3 is a sectional view taken along lines III-III shown in FIG. 2.
Figure 4:
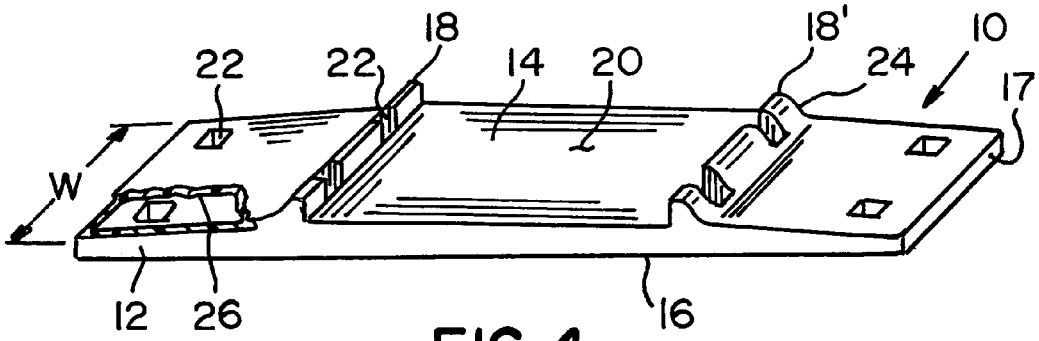
FIG. 4 is a perspective view, partially in section, of the tie plate shown in FIG. 1.
Figure 9:
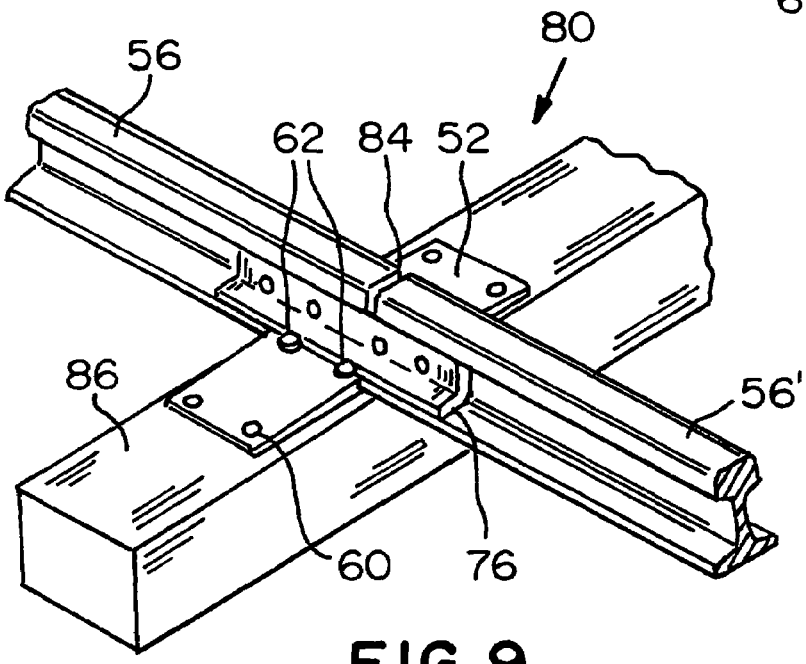
FIG. 9 is a perspective view, partially in section, of an electrically-isolated railroad rail system made in accordance with the present invention.
Figure 10:
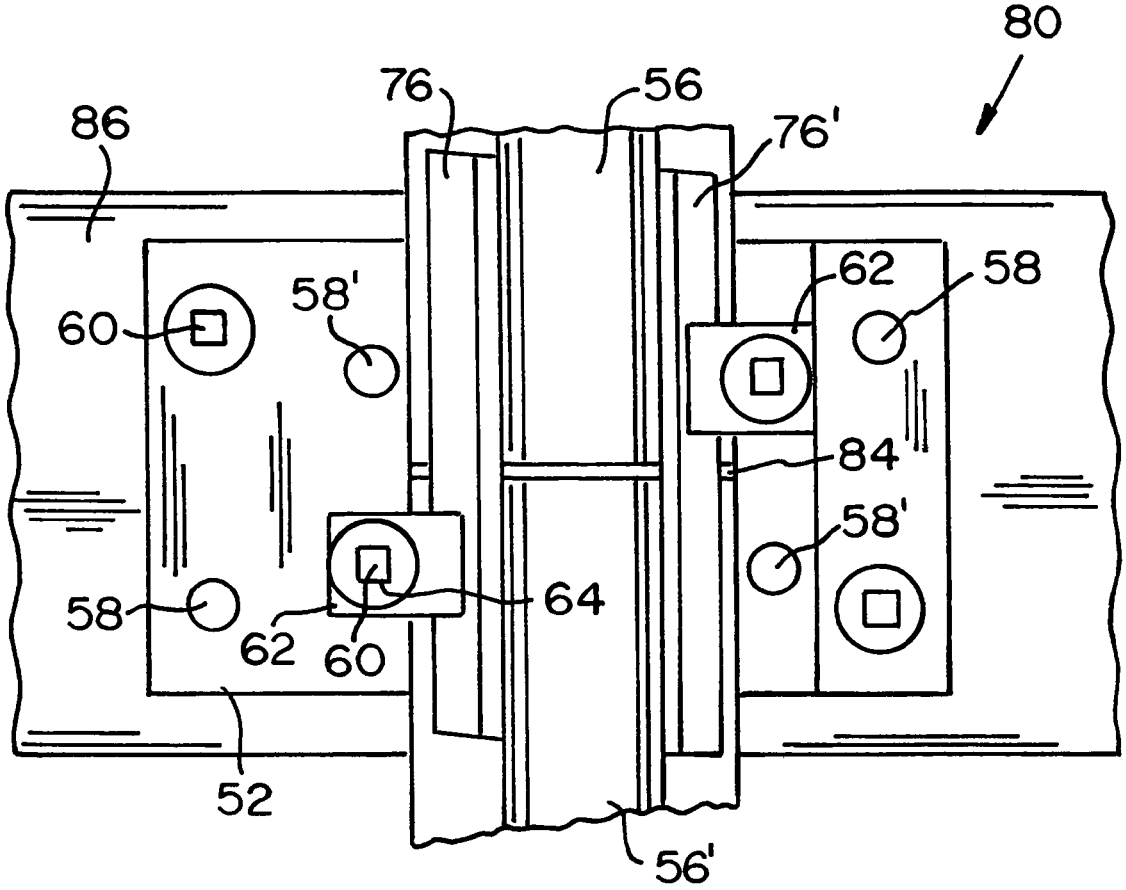
FIG. 10 is a top plan view of a tie plate assembly of the electrically-isolated railroad rail system shown in FIG. 9.

Referring to FIGS. 3 and 4, the tie plate 10 further includes a layer 26 of electrically-insulating material encapsulating the entire base plate 12, thus electrically insulating the tie plate 10. The layer 26 of electrically-insulating material can be a polymeric material, such as polyurethane, ultra high molecular weight polyethylene (UHMWPE), or rubber, a polymeric material containing reinforcing fibers, such as glass fibers, or also a laminated fiber glass may be used. The layer 26 can be molded onto the base plate 12 through any conventional method known in the art. The layer 26 for all embodiments disclosed in FIGS. 3-7 can also be extruded material such as the polymeric material, the polymeric material containing reinforcing fibers, and the laminated fiber glass as previously discussed, wherein the extruded material is adhered via an epoxy onto the base plate 12. The inner surface 24 of each slot 22 can also be covered by an inner layer 28 made of an electrically-insulating material as shown in FIG. 2. The inner layer 28 and the layer 26 can be made of the same electrically-insulating material. The inner layer 28 may be molded onto the inner surface 24 of each slot 22 or, alternatively, the inner layer 28 can be insertable into each of the slots 22, thus conforming to the shape of the inner surface 24 of the slot 22. The inner layer 28 prevents a fastener 60 from contacting the non-insulated inner surface 24 of the slot 22 in the base plate 12, thereby preventing electric current from passing through the fastener 60 and the base plate 12 to the railroad rail 56 (shown in FIG. 8). This is especially important where two separate railroad rails are attached to the same tie plate as shown in FIGS. 9 and 10.

Figure 5:
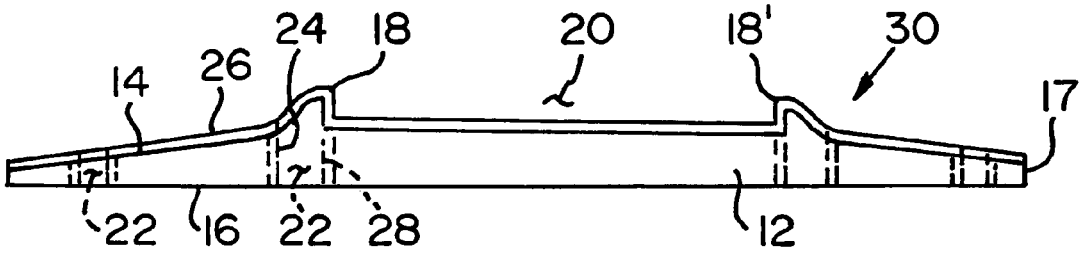
FIG. 5 is a side elevational view of a tie plate made in accordance with a second embodiment of the present invention.

FIG. 5 shows a second embodiment of a tie plate 30, which is similar to a tie plate 10 except for the below noted difference. Like reference numerals are used for like elements. In tie plate 30, only the first surface 14 of the base plate 12 is covered by a layer. 26 of electrically-insulating material instead of the entire base plate 12 as in tie plate 10.

Figure 6:
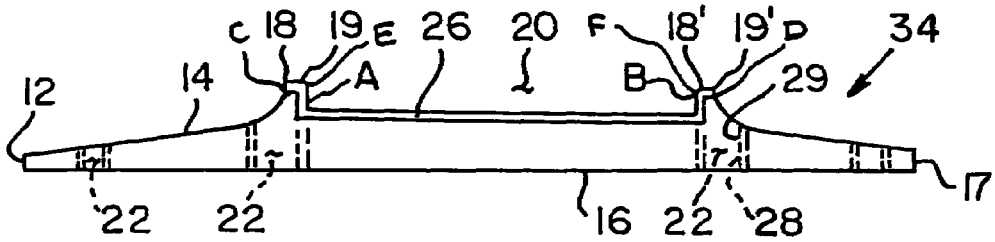
FIG. 6 is a side elevational view of a tie plate made in accordance with a third embodiment of the present invention.

FIG. 6 shows a third embodiment of a tie plate 34, which is similar to a tie plate 30 except for the below noted difference. Like reference numerals are used for like elements. In tie plate 34, only the recessed area 20 and inner surface of the shoulder members 18, 18' on the first surface 14 of the base plate 12 are covered by a layer 26 of electrically-insulating material instead of the entire first surface 14 as in tie plate 30. The layer 26 includes legs A and B connected by a base thereby defining a U-shaped cross section. Optionally, the layer 26 may include lips 19 and 19' depending from legs A and B of the layer 26, wherein the lips 19, 19' cover a shoulder member upper surface C and D of the shoulder members 18, 18', respectively. The layer 26 includes leg upper surfaces E and F positioned above the shoulder member upper surfaces C and D. Preferably, the layer 26 is made of UHMWPE or laminated fiber glass, but other insulating materials may be used.

Figure 7:
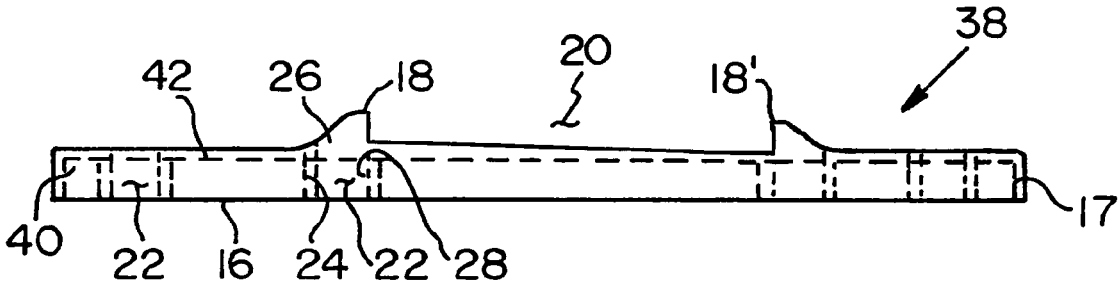
FIG. 7 is a side elevational view of a tie plate made in accordance with a fourth embodiment of the present invention.

FIG. 7 shows a fourth embodiment of a tie plate 38, which is similar to a tie plate 30 except for the below noted difference. Like reference numerals are used for like elements. Tie plate 38 includes a rectangular-shaped base plate 40 having a planar first surface 42. The layer 26 of electrically-insulating material also covers the first surface 42 and the peripheral edges 17 of the base plate 40. The overall shape of the tie plate 38 is similar to tie plates 10, 30, and 34 except that the pair of longitudinal-extending shoulder members 18, 18' are made of an electrically-insulating material.

Figure 8:
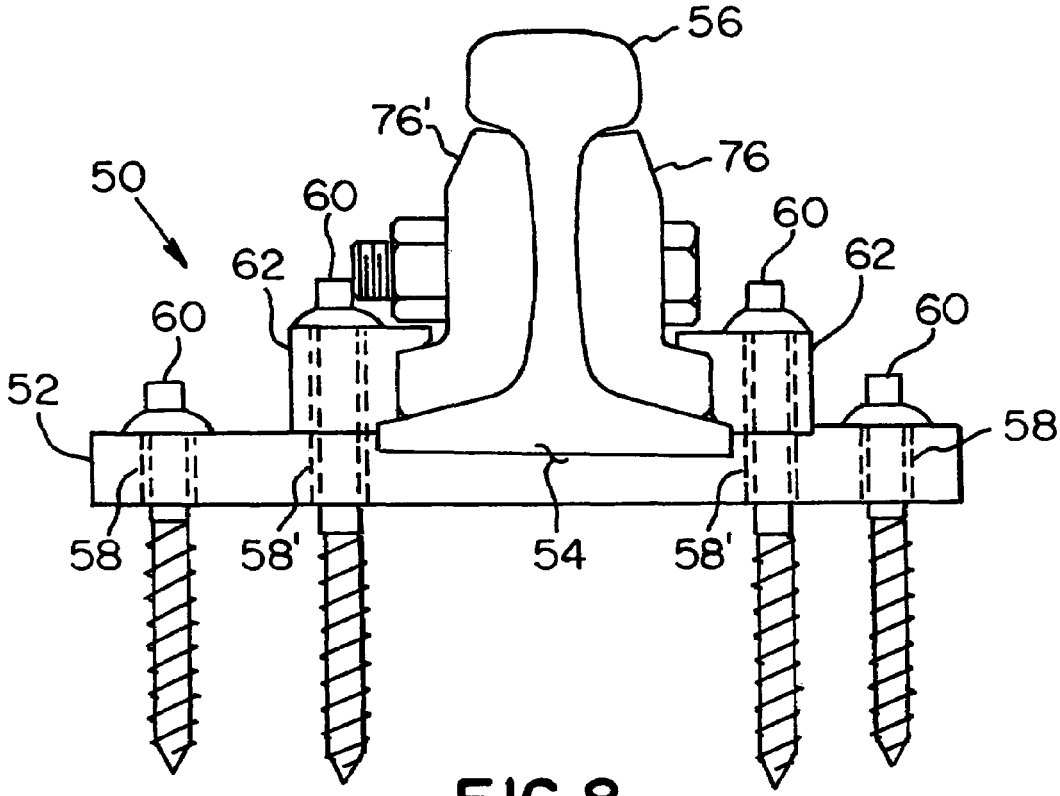
FIG. 8 is a side elevational view of a tie plate assembly made in accordance with the present invention.

FIG. 8 shows a tie plate assembly 50 for a railroad rail 56 made in accordance with the present invention, wherein like reference numerals are used for like elements. The tie plate assembly 50 includes an electrically-insulated tie plate 52 having a recessed area 54 adapted to receive the railroad rail 56, a plurality of slots 58, 58' defined on the tie plate 52, and at least one fastener 60 passing through one of the slots 58, 58' for securing railroad rail 56 to the tie plate 52. The tie plate 52 can be made of an electrically-insulated material, such as fiberglass. Also, the tie plate 52 can be made similar to tie plates 10, 30, 34, and 38 as previously discussed. Also, it is believed that the tie plate 52 can be extruded.

Figure 8A:
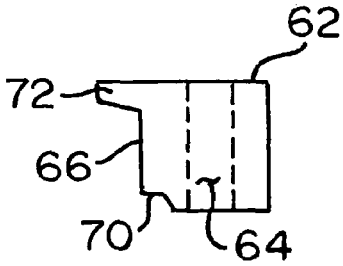
FIG. 8*a* is an elevational view of a clip of the tie plate assembly shown in FIG. 8.

Referring to FIGS. 8 and 8*a*, the tie plate assembly 50 also includes at least one electrically-insulated clip 62 defining a hole 64 for receiving the fastener 60. The clip , 62 can be secured to the tie plate 52 via the fastener 60, wherein the clip 62 has a surface 66 that can coact with the railroad rail 56 or with a rail joint 76 attached to the railroad rail 56 for securing the railroad rail 56 to the tie plate 52. The surface 66 of the clip 62 defines a first ledge 70 that adapts to coact with the railroad rail 56 for securing the railroad rail 56 to the tie plate 52. A second ledge 72 can also be defined on the surface 66 of the clip 62 and adapted to coact with the rail joint 76 attached to the railroad rail 56 in order to secure further the railroad rail 56 to the tie plate 52. The clip 62 can be made of fiberglass or of the same electrically-insulated material as tie plate 52. The clips 62 may be used in conjunction with the other tie plates disclosed herein and/or other types of insulating tie plates, such as, for example, the POLYPLATE® tie plate manufactured by Portec Rail Products, Inc.

FIGS. 9 and 10 show an electrically-isolated railroad rail system 80 made in accordance with the present invention, wherein like reference numerals are used for like elements. The railroad rail system 80 includes a pair of abutting railroad rails 56, 56' having a gasket 84 therebetween and at least one rail joint 76 attaching the railroad rails 56, 56' together. The gasket 84 is generally made of an electrically-insulated material, such as polyurethane, in order to prevent current from passing between the railroad rails 56, 56'. Typically, one rail joint 76 is attached to one side of the railroad rails 56, 56' and another rail joint 76' is attached to the opposite side of the railroad rails 56, 56'. The rail joints 76, 76' can be attached to each side of the railroad rails 56, 56' by welding or using mechanical fasteners. The rail joints 76, 76' are generally electrically-insulated in order to prevent current from passing between railroad rails 56, 56' via the rail joints 76, 76'. Such electrically-insulated rail joints 76, 76' are, for example, a Bonded Insulated Rail Joint™ and a POLYJOINT™ rail joint manufactured by Portec Rail Products, Inc.

With continued reference to FIGS. 9 and 10, the railroad rail system 80 also includes an electrically-insulated tie plate 52 having a recessed area 54 (shown in FIG. 8) and defining a plurality of slots 58, 58' as previously discussed. The tie plate 52 can be any of the electrically-insulated tie plates 10, 30, 34, and 38 as previously discussed. The attached railroad rails 56, 56' are received within the recessed area 54 of the tie plate 52. A fastener 60 passing through one of the slots 58 can be used to secure the tie plate 52 to a rail tie 86. The railroad rail system 80 can include a plurality of electrically-insulated clips 62, each defining a hole 64 as previously discussed. The clips 62, which have a surface 66 defining a first ledge 70 and a second ledge 72 (shown in FIG. 8*a*), can coact with railroad rails 56, 56' and the respective rail joint 76 or 76'. Referring to FIGS. 8 and 9, the first ledge 70 of the clip 62 abuts against a bottom surface of the railroad rail 56 or 56', and the second ledge 72 abuts against a bottom surface of the respective rail joint 76 or 76', wherein the fastener 60 passing through the hole 64 in the clip 62 and one of the slots 58' adjacent the railroad rails 56, 56' can be used to secure both the railroad rails 56, 56' to the tie plate 52 and the tie plate 52 to the rail tie 86.

In operation, an electrically-insulated tie plate 52 is placed on a rail tie 86. Next, a pair of abutting railroad rails 56, 56' having a gasket 84 therebetween are joined together via a pair of rail joints 76, 76', each attached to one side of the pair of abutting railroad rails 56, 56'. Third, the attached railroad rails 56, 56' are then received within a recessed area 54 of an electrically-insulated tie plate 52. Fourth, a hole 64 defined in an electrically-insulated clip 62 is aligned with a slot 58' adjacent the railroad rails 56, 56' in the tie plate 52 so that a surface 66 of the clip 62 contacts both the railroad rail 56 or 56' and the rail joint 76 or 76', respectively. Fifth, a fastener 60 is inserted through the hole 64 in the clip 62 and the slot 58' adjacent the railroad rails 56, 56' in the tie plate 52, wherein the surface 66 of the clip 62 coacts with the railroad rail 56 or 56' and the rail joint 76 or 76', respectively, thus securing the railroad rails 56, 56' to the tie plate 52 and the tie plate 52 to the rail tie 86. Finally, fasteners 60 are inserted through slots 58 in the tie plate 52, thus securing the tie plate 52 to the rail tie 86.

This invention has been described with reference to the preferred embodiments. Obvious modifications and alterations will occur to others upon reading and understanding the preceding detailed description. It is intended that the invention be construed as including all such modifications and alterations.

The invention claimed is:

1. A tie plate, comprising:

a base plate having a first surface and a second surface and defining a peripheral edge;

a pair of longitudinally-extending shoulder members defined on said base plate, said pair of longitudinally-extending shoulder members define a recessed area on said first surface of said base plate for accommodating a railroad rail therebetween;

a layer of electrically-insulating material covering at least said first surface of said base plate; and a plurality of slots defined on said base plate, at least one slot extends transversely through each of said pair of longitudinally-extending shoulder members from said first surface to said second surface of said base plate, said slots each define an inner surface, said inner surface covered by an inner layer made of an electrically-insulating material, wherein said slots are adapted to receive fasteners for securing a railroad rail.

2. The tie plate as claimed in claim 1, wherein said pair of longitudinally-extending shoulder members extend a width of said base plate.

3. The tie plate as claimed in claim 1, wherein said layer encapsulates said base plate.

4. The tie plate as claimed in claim 1, wherein said base plate is a metallic core.

5. The tie plate as claimed in claim 1, wherein said pair of longitudinally-extending shoulder members are made of an electrically-insulating material.

6. The tie plate as claimed in claim 1, wherein said electrically-insulating material comprises a polymeric material.

7. The tie plate as claimed in claim 1, wherein said electrically-insulating material comprises a polymeric material containing reinforcing fibers.

8. The tie plate as claimed in claim 1, wherein said inner layer is molded onto said inner surface of said slots on said base plate.

9. The tie plate as claimed in claim 1, wherein said inner layer is insertable into said slots on said base plate.

10. The tie plate as claimed in claim 1, wherein said layer and said inner layer are made of the same electrically-insulating material.

11. A tie plate assembly for a railroad rail, comprising:

an electrically-insulated tie plate adapted to receive a railroad rail, wherein said tie plate comprises a base plate having a first surface and defining a peripheral edge, a pair of longitudinally-extending shoulder members defined on said base plate, said pair of longitudinally-extending shoulder members define a recessed area on said first surface of said base plate for accommodating a railroad rail therebetween, and a layer of electrically-insulating material covering said first surface of said base plate;

a plurality of slots defined on said tie plate;

a fastener passing through one of said slots for securing said tie plate to a rail tie; and an electrically-insulated clip secured to said tie plate via said fastener, said clip having a surface comprising a first ledge and a second ledge, said first ledge adapted to coact with the railroad rail and said second ledge adapted to coact with a rail joint attached to the railroad rail for securing the railroad rail to said tie plate.

12. The tie plate assembly as claimed in claim 11, wherein said tie plate is made of an electrically-insulated material.

13. The tie plate assembly as claimed in claim 11, wherein said tie plate is made of fiberglass.

14. The tie plate assembly as claimed in claim 11, wherein said clips are made of an electrically-insulating material.

15. The tie plate assembly as claimed in claim 11, wherein said clips are made of fiberglass.

16. An electrically-insulated tie plate, comprising:

a metallic core having a first surface and a second surface and defining a peripheral edge;

a plurality of slots having an inner surface defined in said metallic core;

a pair of longitudinally-extending shoulder members defined on said metallic core, said pair of longitudinally-extending shoulder members define a recessed area on said first surface of said metallic core for accommodating a railroad rail therebetween, wherein at least one slot extends transversely through each of said pair of longitudinally-extending shoulder members from said first surface to said second surface of said metallic core; and a layer of electrically-insulating material covering said first surface of said metallic core and said inner surface of said slots.

17. The tie plate as claimed in claim 16, wherein said pair of longitudinally-extending shoulder members are made of an electrically-insulating material.

18. An electrically-isolated railroad rail system, comprising:

a pair of railroad rails;

a rail joint attaching each of said railroad rails together;

an electrically-insulated tie plate having a plurality of slots for receiving said attached railroad rails;

a fastener passing through one of said slots for securing said tie plate to a rail tie; and an electrically-insulated clip secured to said tie plate via said fastener, said clip having a surface comprising a first ledge and a second ledge, said first ledge adapted to coact with said railroad rail and said second ledge adapted to coact with said rail joint for securing said railroad rail to said tie plate.

19. The tie plate as claimed in claim 1, wherein said layer is an extruded member adhered to said first surface of said base plate.

20. A tie plate, comprising:

a base plate having a first surface and a second surface and defining a peripheral edge;

a pair of longitudinally-extending shoulder members defined on said base plate, wherein a recessed area is defined between said pair of longitudinally-extending shoulder members for accommodating a railroad rail therebetween, the recessed area defined by an inner surface of said pair of longitudinally-extending shoulder members and a portion of said first surface of said base plate;

a layer of electrically-insulating material, said layer includes a pair of legs connected by a base and defining a U-shaped cross-section covering said inner surface of said pair of longitudinally-extending shoulder members and said first surface of the recessed area of said base plate, wherein said layer further comprises lips covering an upper surface of said shoulder members, wherein each lip depends from a respective leg, wherein a remaining portion of said first surface and said second surface of said base plate does not include a layer of electrically-insulating material; and a plurality of slots defined on said base plate and spaced from said pair of longitudinally-extending shoulder members, said slots extend transversely through said base plate from said first surface to said second surface.

21. The tie plate as claimed in claim 20, wherein said base plate is made of metal and said electrically-insulating material is a polymeric material.

22. A tie plate, comprising:

a base plate having a first surface and a second surface and defining a peripheral edge;

a pair of longitudinally-extending shoulder members defined on said base plate, each of said shoulders having a shoulder upper surface, wherein a recessed area is defined between said pair of longitudinally-extending shoulder members for accommodating a railroad rail therebetween, the recessed area defined by an inner surface of said pair of longitudinally-extending shoulder members and a portion of said first surface of said base plate;

a layer of electrically-insulating material, said layer includes a pair of legs connected by a base and defining a U-shaped cross-section covering said inner surface of said pair of longitudinally-extending shoulder members and said first surface of the recessed area of said base plate, each of said legs having an upper surface wherein said upper surface of said pair of legs are positioned above said respective shoulder upper surfaces, wherein a remaining portion of said first surface and said second surface of said base plate does not include a layer of electrically-insulating material; and a plurality of slots defined on said base plate and spaced from said pair of longitudinally-extending shoulder members, said slots extend transversely through said base plate from said first surface to said second surface.

23. A tie plate arrangement, comprising:

a base plate having a first surface and a second surface and defining a peripheral edge;

a pair of longitudinally-extending shoulder members defined on said base plate, each of said shoulders having a shoulder upper surface, wherein a recessed area is defined between said pair of longitudinally-extending shoulder members for accommodating a railroad rail therebetween, the recessed area defined by an inner surface of said pair of longitudinally-extending shoulder members and a portion of said first surface of said base plate;

a layer of electrically-insulating material, said layer includes a pair of legs connected by a base and defining a U-shaped cross-section covering said inner surface of said pair of longitudinally-extending shoulder members and said first surface of the recessed area of said base plate, each of said legs having an upper surface wherein said upper surface of said pair of legs are positioned above said respective shoulder upper surfaces, wherein a remaining portion of said first surface and said second surface of said base plate does not include a layer of electrically-insulating material; and a plurality of slots defined on said base plate and spaced from said pair of longitudinally-extending shoulder members, said slots extend transversely through said base plate from said first surface to said second surface;

a fastener passing through one of said slots for securing said base plate to a rail tie; and a clip secured to said base plate via said fastener, said clip having a surface comprising a ledge adapted to coact with a rail joint attached to the railroad rail for securing the railroad rail to said tie plate.

24. The tie plate arrangement as claimed in claim 23, wherein said clip comprises an electrically-insulated material.

* * * * *